US005348321A

United States Patent [19]

Sbrilli

[11] Patent Number: 5,348,321

[45] Date of Patent: Sep. 20, 1994

[54] SKATE WITH ALIGNED WHEELS

[75] Inventor: Franco Sbrilli, Marghera, Italy

[73] Assignee: Nordica S.p.A., Montebelluna, Italy

[21] Appl. No.: 69,799

[22] Filed: Jun. 1, 1993

[30] Foreign Application Priority Data

Jun. 10, 1992 [IT] Italy ..... VE92A000022

[51] Int. Cl.[5] ..... A63C 17/04

[52] U.S. Cl. ..... 280/11.22; 280/11.27

[58] Field of Search ..... 280/11.22, 11.23, 11.19, 280/11.27, 11.28

[56] References Cited

U.S. PATENT DOCUMENTS 2,166,767 7/1939 Petermann ..... 280/11.22

2,212,589 8/1940 Decker .

4,666,168 5/1987 Hamill et al. ..... 280/11.27

4,928,982 5/1990 Logan ..... 280/11.22

FOREIGN PATENT DOCUMENTS 0486013 5/1992 European Pat. Off. .

965557 6/1957 Fed. Rep. of Germany .

579406 9/1976 Switzerland .

*Primary Examiner*—Richard M. Camby

*Attorney, Agent, or Firm*—Guido Modiano; Albert Josif; Daniel O'Byrne

[57] ABSTRACT

A skate with aligned wheels having a single plate provided with cantilever pivots for supporting the wheels. The pivots have a quick-release device for easily and rapidly removing and replacing the wheels.

5 Claims, 2 Drawing Sheets

SKATE WITH ALIGNED WHEELS

BACKGROUND OF THE INVENTION

Conventional skates with aligned wheels are currently provided with a fork-like plate or chassis, having a U-shaped cross section, which supports the wheels by means of through pivots fixed to the sides of the fork or chassis.

When the wheels have to be replaced, or removed for simple maintenance, for cleaning the bearings for example, the fork-like plate creates great difficulty in this disassembly.

Later, when the wheels must be reassembled, great care must be taken to position them correctly.

SUMMARY OF THE INVENTION

A main object of the invention is to allow a rapid disassembly and assembly of the wheels with respect to conventional skates.

A further object of the invention is to provide a skate having a lower weight.

The above objects, and others which will be more apparent later, are achieved by a skate with aligned wheels characterized in that it comprises a single plate having a plurality of cantilever pivots each adapted to support a wheel.

BRIEF DESCRIPTION OF THE DRAWINGS

Further characteristics and advantages of the invention will become apparent from the following description of preferred embodiments thereof, illustrated by way of example, in the enclosed drawings, wherein.

DESCRIPTION OF THE PREFERRED EMBODIMENTS

Figure 2:
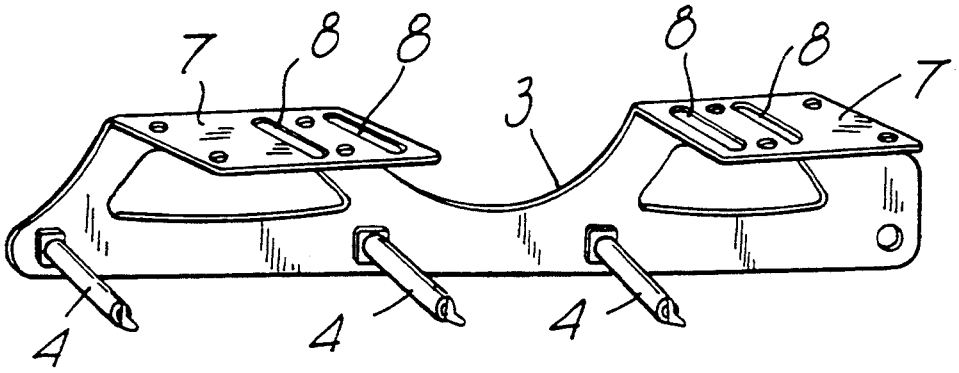
FIG. 2 is a perspective view of a supporting plate of the skate of FIG. 1.
Figure 3:
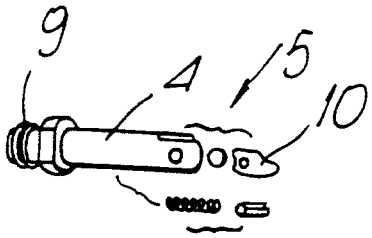
FIG. 3 is an exploded detail view of a quick-release system of the skate according to the present invention.
Figure 1:
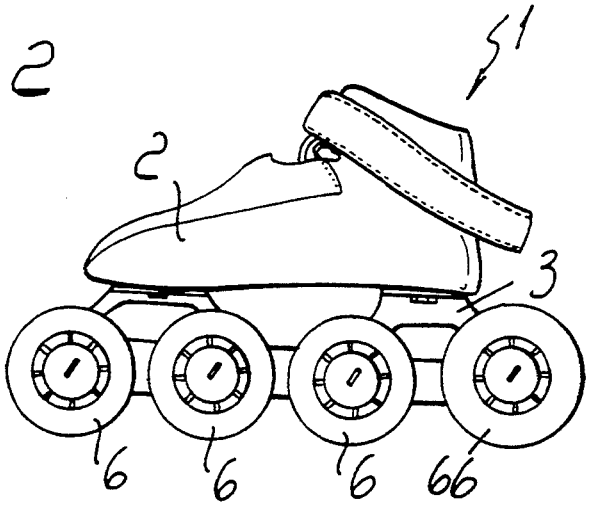
FIG. 1 is a side view of a skate according to the invention.

With reference to the figures, the skate 1 comprises a skating shoe 2 which is provided, on its sole, with a single plate 3 which supports pivots 4 provided with a quick-release device 5 for aligned wheels 6. The pivots 4 are associated with the plate in a cantilever manner.

The single plate 3 is advantageously made of light alloy, for example titanium, and is provided with two upper wings 7 which are advantageously fixed to the shoe with the same couplings as provided for fixing an ice blade to a conventional ice skate; two rectangular openings 8 are also provided on the wings so as to obtain perfect positioning of the plate on the shoe.

The single plate can have various shapes and dimensions, depending on whether the skate is for road or rink use, and can support two or more pivots 4 for supporting two or more wheels 6, which can have various widths and diameters.

The pivots arranged on the single plate are of the quick-release type to allow to replace the wheels easily and to allow quicker maintenance. In this manner it is possible to quickly and easily change the wheels, replacing them with harder or softer ones according to terrain conditions. The quick-release devices are composed of a pivot 4 on which the wheel 6 is fitted; the pivot is threaded at one end 9, on the side where it is screwed onto the single plate, and is provided, at its opposite end, with a lever 10 for retaining the wheel. The retainer may be a conventional quick-release retainer, already commercially available for conventional speed skates.

The quick-release system can be opened simply with a slight pressure of the fingers on the retainer; in this manner it is also possible to obtain effective and rapid maintenance of the skate and of the wheels.

When the skate touches the ground, the wheels tend to slow down; a larger diameter of the rear wheel 66 therefore allows the skater to go faster.

Since the single plate is coupled to the shoe with the same couplings as an ice blade, it can thus be interchanged with an ice-skating blade.

Figure 4:
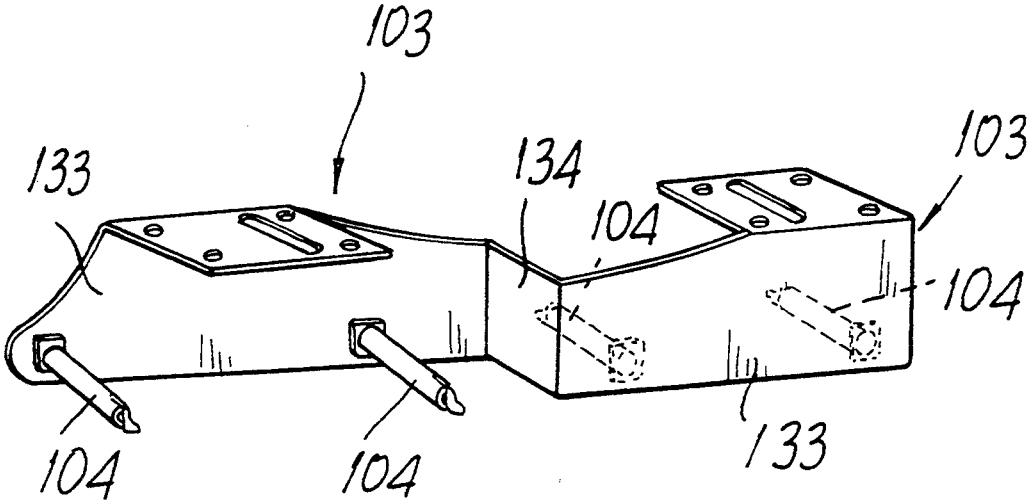
FIG. 4 is a perspective view of a supporting plate according to a second aspect of the invention.
Figure 5:
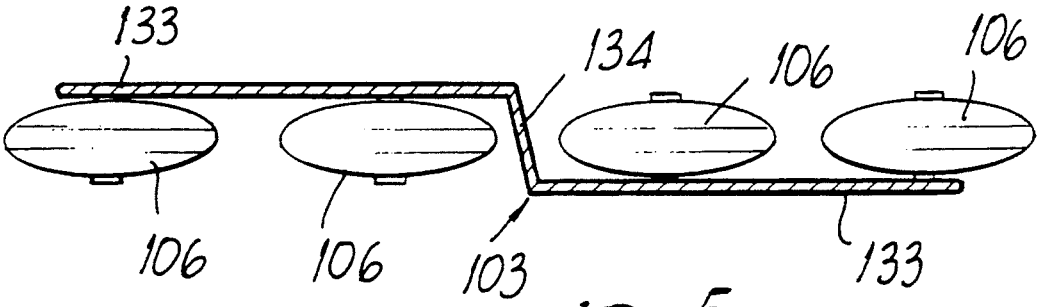
FIG. 5 is a top view of the plate of FIG. 4 with wheels connected thereto.

FIGS. 4–5 illustrate a single plate 103 according to a second aspect of the invention, wherein the wheels 106 are associated two by two at opposite sides.

The single plate 103 comprises two parallel sections 133 connected by a transverse section 134. The pivots 104 are associated in pairs on opposite sides of the plate 103.

Figure 6:
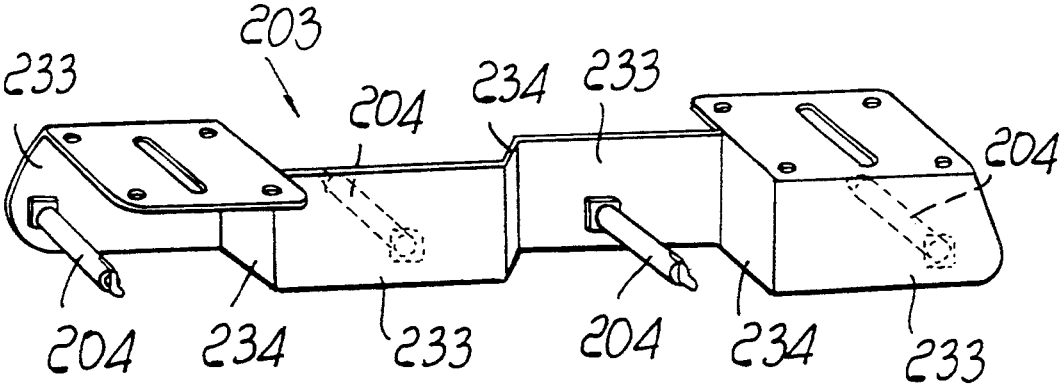
FIG. 6 is a perspective view of a supporting plate according to a third aspect of the invention.
Figure 7:
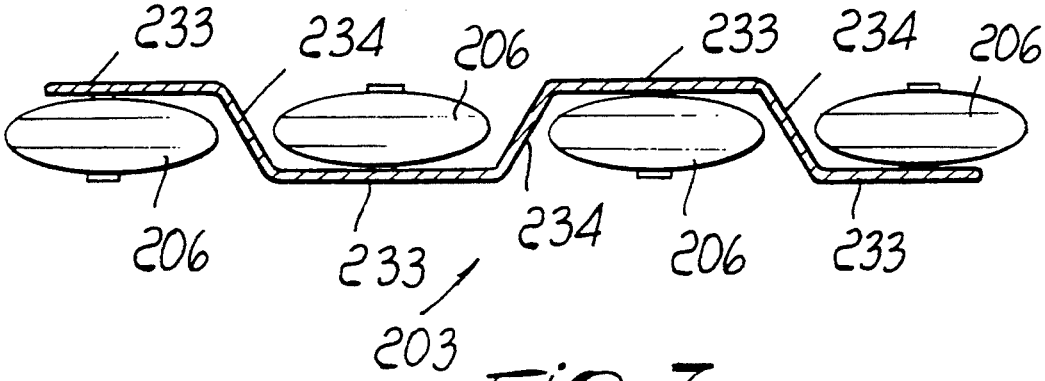
FIG. 7 is a top view of the plate of FIG. 6 with wheels connected thereto.

FIGS. 6–7 illustrate a single plate 203 according to a third aspect of the invention, wherein each wheel 206 is associated with the plate on the opposite side with respect to the adjacent wheel.

The single plate 203 comprises a plurality of parallel sections 233 connected by transverse sections 234. Each pivot 204 is associated at a respective parallel section 233.

The skate provided with either the plate of FIGS. 4–5 or the plate of FIGS. 6–7 has an improved stability and balancing because of the greater rigidity of the plate 103, 203.

The skate according to the invention is susceptible to numerous modifications and variations, all of which are within the scope of the same inventive concept.

The materials employed, as well as the dimensions, may be any according to the specific needs and the state of the art.

I claim:

1. A skate with aligned wheels, comprising:

a single wheel supporting plate;

a plurality of cantilever pivots connected to said supporting plate;

a plurality of wheels rotatably supported by said cantilever pivots;

said single supporting plate comprising a first section and a second section, said first section and said second section being substantially mutually parallel, said single supporting plate furthermore comprising a transverse section disposed in a vertical plane, interconnected between said first section and said second section, a first pair of said pivots being connected to said first section at a first side of said supporting plate, and a second pair of said pivots being connected to said second section at a second side of said supporting plate which is opposite to said first side thereof.

2. The skate according to claim 1, wherein said cantilever pivots comprise quick-release devices for fastening said wheels.

3. A skate with aligned wheels, comprising:

a single wheel supporting plate;

a plurality of cantilever pivots connected to said supporting plate;

a plurality of wheels rotatably supported by said cantilever pivots;

said single supporting plate comprising a first section and a second section, said first section and said second section being substantially mutually parallel, said single supporting plate furthermore comprising a first transverse section disposed in a vertical plane, interconnected between said first section and said second section, at least one first pivot of said pivots being connected to said first section at a first side of said supporting plate, and at least one second pivot of said pivots being connected to said second section at a second side of said supporting plate which is opposite to said first side thereof.

4. The skate according to claim 3, wherein said cantilever pivots comprise quick-release devices for fastening said wheels.

5. The skate according to claim 3, further comprising:

a third section and a fourth section both of which are substantially parallel to said first and second sections;

a second transverse section interconnected between said first section and said third section;

a third transverse section interconnected between said second section and said fourth section;

at least one third pivot of said pivots connected to said third section at said second side of said supporting plate; and at least one fourth pivot of said pivots connected to said fourth section at said first side of said supporting plate.

* * * * *